US007272343B2

(12) United States Patent
Takahashi et al.

(10) Patent No.: US 7,272,343 B2
(45) Date of Patent: Sep. 18, 2007

(54) IMAGE FORMING APPARATUS HAVING A CONVEYANCE UNIT AND A FRONT-SIDE PLATE FRAME STRUCTURE OF SUCH AN IMAGE FORMING APPARATUS

(75) Inventors: Hiroshi Takahashi, Kanagawa (JP); Hirotsugu Shirai, Kanagawa (JP); Takamichi Fujitate, Saitama (JP); Kyosuke Suzuki, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 370 days.

(21) Appl. No.: 10/825,300

(22) Filed: Apr. 16, 2004

(65) Prior Publication Data

US 2005/0134668 A1 Jun. 23, 2005

(30) Foreign Application Priority Data

Apr. 18, 2003 (JP) ..... 2003-114219

(51) Int. Cl.
*G03G 21/00* (2006.01)

(52) U.S. Cl. ..... 399/124

(58) Field of Classification Search ..... 399/107, 399/121, 122, 124, 405
See application file for complete search history.

(56) References Cited

U.S. PATENT DOCUMENTS

| | | | | |
|---|---|---|---|---|
| 5,134,443 | A * | 7/1992 | Sumi et al. | 399/121 |
| 5,418,606 | A * | 5/1995 | Kikuchi et al. | 399/381 |
| 5,797,068 | A * | 8/1998 | Otsuki et al. | 399/110 |
| 6,233,427 | B1 * | 5/2001 | Hirota et al. | 399/407 |
| 6,641,132 | B2 | 11/2003 | Sekine | |
| 6,726,197 | B2 | 4/2004 | Aoki | |
| 6,799,011 | B2 * | 9/2004 | Abe et al. | 399/299 |
| 6,801,742 | B1 * | 10/2004 | Mochimaru et al. | 399/309 |
| 6,993,268 | B2 * | 1/2006 | Otaka | 399/124 |
| 7,031,640 | B2 * | 4/2006 | Komoda et al. | 399/124 |

FOREIGN PATENT DOCUMENTS

| | | | |
|---|---|---|---|
| JP | 06001471 | A * | 1/1994 |
| JP | 8-339108 | | 12/1996 |
| JP | 2002014555 | A * | 1/2002 |
| JP | 2002-46922 | | 2/2002 |
| JP | 2002-296857 | | 10/2002 |

OTHER PUBLICATIONS

U.S. Appl. No. 10/352,062, filed Jan. 28, 2003, Yanagida.

* cited by examiner

*Primary Examiner*—Robert Beatty
(74) *Attorney, Agent, or Firm*—Oblon, Spivak, McClelland, Maier & Neustadt, P.C.

(57) ABSTRACT

An image forming apparatus has an internal paper-eject structure to provide an easy maintenance work and an easy operation for removing jammed papers. An internal eject part is provided above an image forming part. A conveyance unit is provided between the image forming part and the internal eject part. The conveyance unit includes a transfer device that transfers the visible image onto the transfer material, a fixing device that fixes the visible image and an upward conveyance part that conveys and ejects the transfer material to the internal eject part. The transfer device, the fixation device and the upward conveyance part are incorporated into a single unit. A front-side plate frame serving as a reinforcing member is provided along a periphery of a front-side opening of the image forming part and having a protruding part extending upward along a side of the internal eject part and having an opening corresponding to an outer configuration of the conveyance unit.

18 Claims, 5 Drawing Sheets

IMAGE FORMING APPARATUS HAVING A CONVEYANCE UNIT AND A FRONT-SIDE PLATE FRAME STRUCTURE OF SUCH AN IMAGE FORMING APPARATUS

BACKGROUND OF THE INVENTION

1. Field of the Invention

The present invention generally relates to image forming apparatuses such as a copy machine, a facsimile machine or a printer and, more particularly, to a conveyance unit used in an image forming apparatus having a paper eject part above an image forming part, an image forming apparatus having such a conveyance unit and a front-side plate frame structure having a reinforcing member that constitutes a front side of an image forming apparatus.

2. Description of the Related Art

In an image forming apparatus, such as a copy machine, a facsimile machine or a printer, an image forming part forms a visible image on a recording medium such as a recording paper in accordance with image data that is acquired by reading a document reading part, received from an external apparatus through a communication line such as a telephone network or sent from a host computer. After the visible image are formed on the recording paper, the recording paper is conveyed to a paper eject part so as to eject the recording paper to outside. More specifically, the image forming part of the image forming apparatus forms a latent image on an image carrier such as a photoconductor in accordance with the image data, develops the latent image by developer in a developing device so as to visualize the image data, transfer the visible image onto a transfer material such as the recording paper by a transfer device, and fixes the transferred visible image by a fixing device. Then, the image forming part conveys the recording paper, which has been subjected to the fixing process, to the paper eject part that ejects the recording paper onto a paper eject tray, etc.

In an image forming apparatus such as a copy machine, a facsimile machine or a multi-function machine having a printer function, it is general to locate a document reading part above an image forming part that forms an image and arrange a paper supply part under the image forming part. For this reason, a paper-eject part such as a paper-eject tray onto which copies or printed papers are provided on a side of the image forming apparatus. However, when the paper-eject part is provided on a side of the apparatus, an occupied area of the apparatus is increased, which causes a problem in that a location for installing the image forming apparatus is restricted especially in a narrow office.

In order to achieve a compact structure by omitting a part protruding on a side of the image forming apparatus, a paper eject space may be provided inside the body of the image forming apparatus so as to place an internal paper-eject part in the paper eject space. Such an image forming apparatus is suggested in patent documents 1)-3) mentioned below. Specifically, the paper-eject space is provided between an image forming part and a document reading part, and the internal paper-eject part is constituted by providing a paper-eject tray in the paper-eject space. Moreover, in the image forming apparatus having such an internal paper-eject part, in order to convey printed papers, on which images are formed by the image forming part, to the internal paper-eject part, an upward conveyance part is provided in an area from the image forming part to a side of the internal paper eject part so as to convey and eject the printed papers to the internal paper-eject part.

In the image forming apparatus having such an internal paper-eject part, although an occupied area of the apparatus can be maintained small since the paper-eject space is provided between the image forming part and the document reading part, there is a problem in that a height of the image forming apparatus is increased. Particularly, if a multi-stage paper-eject part is located under the image forming apparatus, a height of the image forming apparatus is considerably increased. For this reason, in order to maintain the height of the image forming apparatus within an allowable range, a space for providing the image forming part must be reduced. However, if the space for mounting the image forming part is reduced, the workability of maintenance of the image forming apparatus is sacrificed. Moreover, when a paper jam, etc., occurs in the conveyance path of papers, there is a problem that it is difficult to perform an operation to remove the named papers.

Moreover, the image forming apparatus provided with the internal paper-eject part has a structure in which a front side of the internal paper-eject part of the apparatus body is open so that printed papers ejected on the tray of the internal paper-eject part can be easily taken out. For this reason, there is a problem that strength of the front side of the apparatus body is reduced. Thus, a structure of maintaining the strength of the front side is adopted in which a plate-like frame is provided on the front side of the image forming part to support the front side of the paper-eject tray. However, in this case, the workability of a maintenance work and an operation for paper jamming is deteriorated.

1) Patent Document: Japanese Laid-Open Patent Application No. 8-339108

2) Patent Document: Japanese Laid-Open Patent Application No. 2002-296857

3) Patent Document: Japanese Laid-Open Patent Application No. 2002-46922

SUMMARY OF THE INVENTION

It is a general object of the present invention to provide an improved and useful image forming apparatus in which the above-mentioned problems are eliminated.

A more specific object of the present invention is to provide an image forming apparatus having an internal paper-eject structure, which can provide an easy maintenance work and an easy operation for removing jammed papers.

Another object of the present invention is to provide a sufficient strength of a front side apparatus body of an image forming apparatus.

In order to achieve the above-mentioned objects, there is provided according to one aspect of the present invention a conveyance unit configured and arranged to be used in an image forming apparatus that comprises an image forming part for forming a visible image on a transfer material and an internal eject part provided above the image forming part within the image forming apparatus, wherein the conveyance unit is provided on a conveyance path from the image forming part to the internal eject part, the conveyance unit comprising: a transfer device that transfers the visible image, which is formed on an image carrier, onto the transfer material; a fixing device that fixes the visible image transferred to the transfer material; and an upward conveyance part that conveys and ejects the transfer material having a fixed visible image to the internal eject part, wherein the transfer device, the fixation device and the upward conveyance part are incorporated into a single unit.

In the above-mentioned conveyance unit, the upward conveyance part may extend, when situated in the image forming apparatus, upwardly from an end of the conveyance unit and along a side of the internal eject part. Additionally, the entire conveyance unit may be configured and arranged to be removable from an interior of an apparatus body of the image forming apparatus through a front side of the apparatus body.

There is provided according to another aspect of the present invention an image forming apparatus comprising: an image forming part that forms a visible image on a transfer material; an internal eject part provided above the image forming part within the image forming apparatus; and a conveyance unit provided on a conveyance path from the image forming part to the internal eject part, wherein the conveyance unit comprises: a transfer device that transfers the visible image, which is formed on an image carrier, onto the transfer material; a fixing device that fixes the visible image transferred to the transfer material; and an upward conveyance part that conveys and ejects the transfer material having a fixed visible image to the internal eject part, wherein the transfer device, the fixation device and the upward conveyance part are incorporated into a single unit.

In the above-mentioned image forming apparatus, the upward conveyance part may extend, when situated in the image forming apparatus, upwardly from an end of the conveyance unit and along a side of the internal eject part. Additionally, the entire conveyance unit may be configured and arranged to be removable from an interior of an apparatus body of the image forming apparatus through a front side of the apparatus body.

Additionally, there is provided according to another aspect of the present invention a structure of a front-side plate frame serving as a reinforcing member to reinforce a front side of an image forming apparatus that comprises: an image forming part that forms a visible image on a transfer material; an internal eject part provided above the image forming part within the image forming apparatus; and a conveyance unit provided on a conveyance path from the image forming part to the internal eject part, wherein the conveyance unit comprises: a transfer device that transfers the visible image, which is formed on an image carrier, onto the transfer material; a fixing device that fixes the visible image transferred to the transfer material; and an upward conveyance part that conveys and ejects the transfer material having a fixed visible image to the internal eject part, wherein the transfer device, the fixation device and the upward conveyance part are incorporated into a single unit, and wherein the front-side plate frame is provided along a periphery of a front-side opening of the image forming part and has a protruding part extending upward along a side of the internal eject part and has an opening corresponding to an outer configuration of the conveyance unit.

In the above-mentioned structure of the front-side plate frame, the front-side plate frame may be interposed between component parts of a frame member constituting an apparatus body of the image forming apparatus. The component parts of the frame member may be pipe frames serving as columns of the frame member.

Additionally, in the structure of the front-side plate frame, a reinforcing member may be attached to the front-side plate frame at an area corresponding to a root of the protruding part, where a stress is concentrated when a load is applied to the front-side plate frame. The reinforcing member may be an L-shape bracket. Additionally, in the structure of the front-side plate frame, an outer front cover covering the front side of the image forming part may be configured to be a double door structure so that a center line of the double door passes through the root of the protruding part, and the reinforcing member is a bracket having a magnet for locking the outer front cover.

The above-mentioned structure of the front-side plate frame may further comprise an interlock mechanism provided to the bracket so as to detect opening and closing of the outer front cover and control an operation of the image forming apparatus.

Additionally, there is provided according to another aspect of the present invention an image forming apparatus comprising: an image forming part that forms a visible image on a transfer material; an internal eject part provided above the image forming part within the image forming apparatus; a conveyance unit provided on a conveyance path from the image forming part to the internal eject part, the conveyance unit including: a transfer device that transfers the visible image, which is formed on an image carrier, onto the transfer material; a fixing device that fixes the visible image transferred to the transfer material; and an upward conveyance part that conveys and ejects the transfer material having a fixed visible image to the internal eject part, wherein the transfer device, the fixation device and the upward conveyance part are incorporated into a single unit; and a front-side plate frame serving as a reinforcing member to reinforce a front side of the image forming apparatus, the front-side plate frame provided along a periphery of a front-side opening of the image forming part and having a protruding part extending upward along a side of the internal eject part and having an opening corresponding to an outer configuration of the conveyance unit.

In the above-mentioned image forming apparatus, the front-side plate frame may be interposed between component parts of a frame member constituting an apparatus body of the image forming apparatus. The component parts of the frame member may be pipe frames serving as columns of the frame member.

In the above-mentioned image forming apparatus, a reinforcing member may be attached to the front-side plate frame at an area corresponding to a root of the protruding part, where a stress is concentrated when a load is applied to the front-side plate frame. The reinforcing member may be an L-shape bracket.

In the above-mentioned image forming apparatus, an outer front cover covering the front side of the image forming part may be configured to be a double door structure so that a center line of the double door passes through the root of the protruding part, and the reinforcing member is a bracket having a magnet for locking the outer front cover. The image forming apparatus may further comprise an interlock mechanism provided to the bracket so as to detect opening and closing of the outer front cover and control an operation of the image forming apparatus.

According to the present invention, a transfer device, a fixing device and a conveyance mechanism are incorporated into a conveyance unit so that the conveyance unit can be removed from the apparatus body of the image forming apparatus through the front-side thereof. Thereby, good workability of a maintenance operation is provided, and an easy operation to remove papers jammed in the apparatus body of the image forming apparatus can be achieved.

Additionally, according to the present invention, the image forming apparatus has a front-side plate frame serving as a reinforcing member that reinforces the front side of the apparatus body of the image forming apparatus. The front-side plate frame is provided along a periphery of a front-side opening of the image forming part. The front-side plate frame has a protruding part extending upward along a side of said internal eject part and also has an opening corresponding to an outer configuration of the conveyance unit. Thus, the entire conveyance unit can be taken out of the apparatus body of the image forming apparatus easily through the opening formed in the front-side plate frame while acquiring a sufficient strength of the front side of the image forming part and the internal eject part.

Other objects, features and advantages of the present invention will become more apparent from the following detailed description when read in conjunction with the accompanying drawings.

DETAILED DESCRIPTION OF THE PREFERRED EMBODIMENTS

Figure 1:
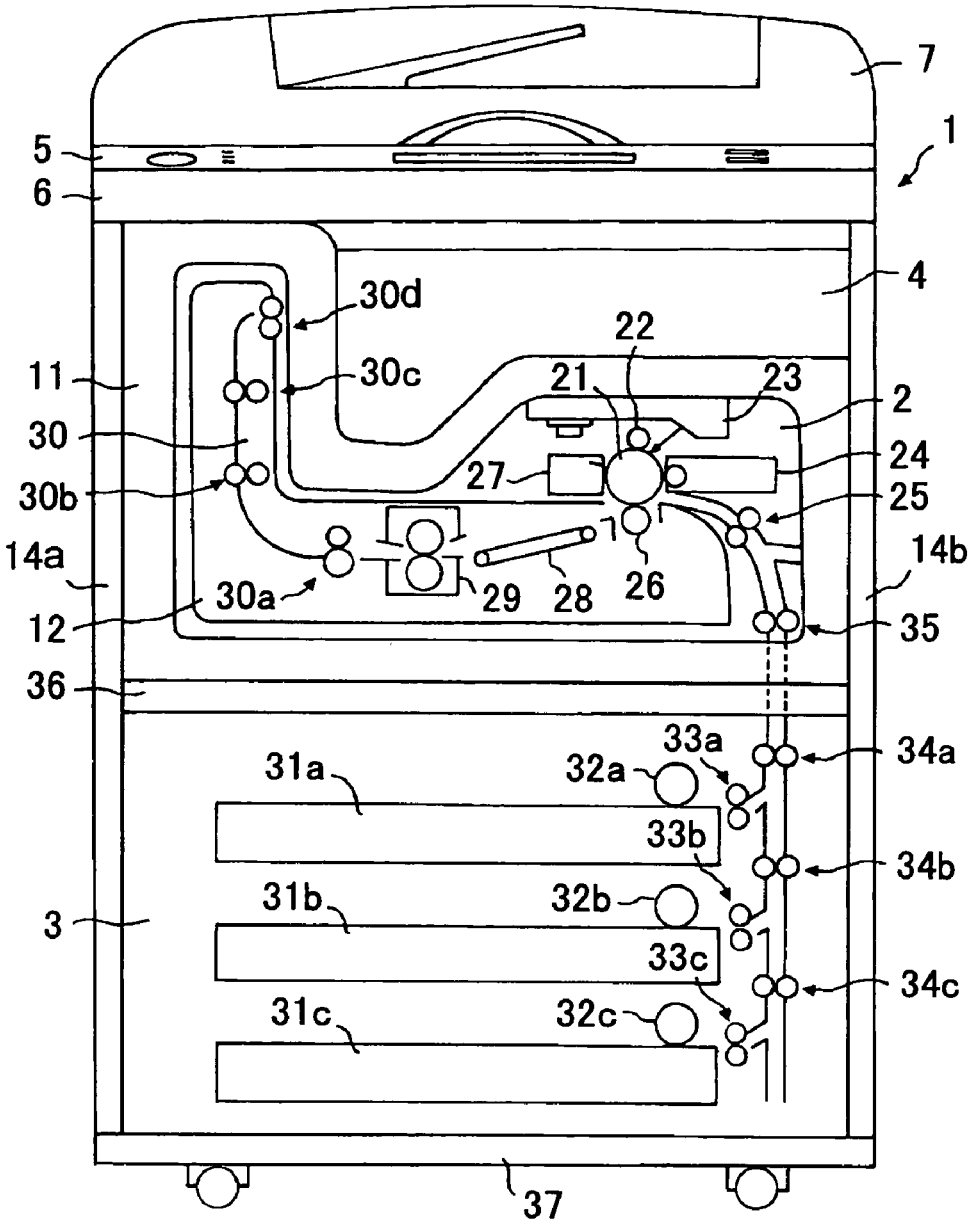
FIG. 1 is an illustration showing an entire structure of an image forming apparatus according to an embodiment of the present invention.
Figure 2:
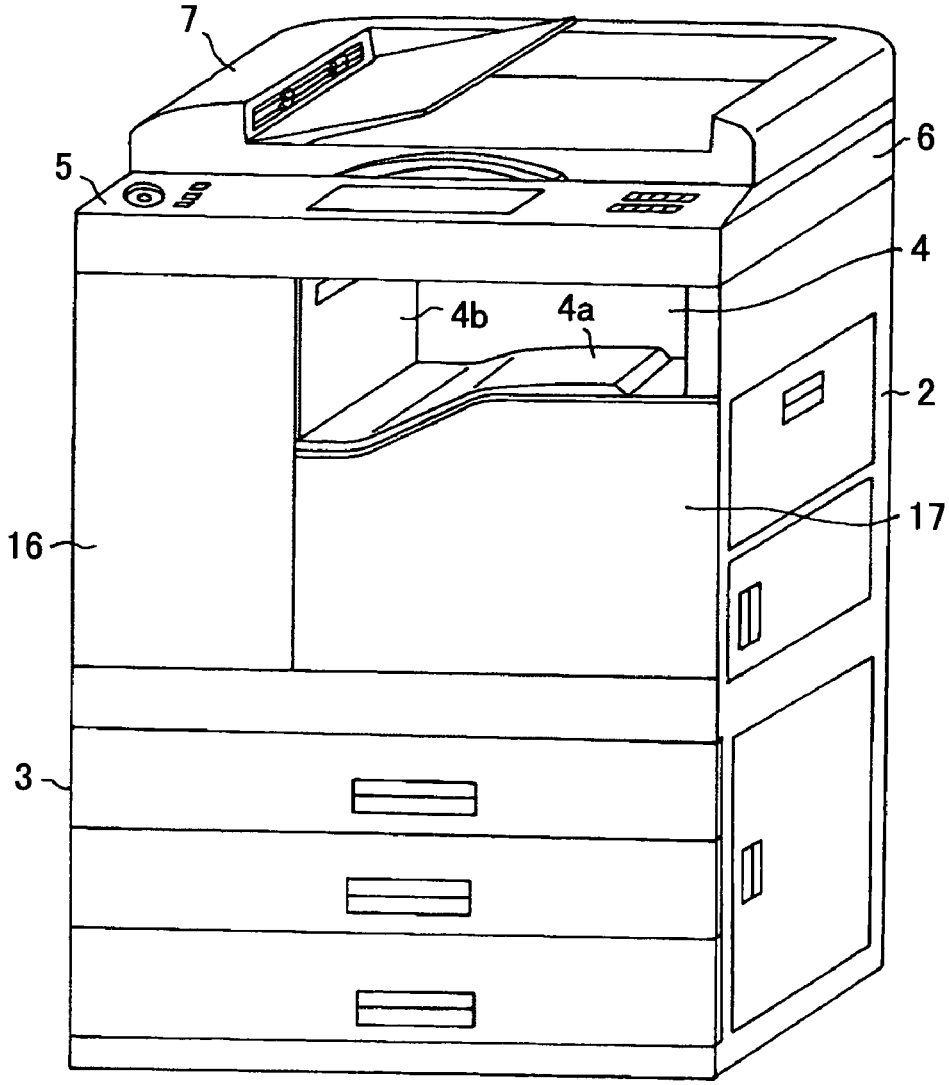
FIG. 2 is a perspective view of the image forming apparatus shown in FIG. 1.

A description will now be given, with reference to the drawings, of a structure and operations of an image forming apparatus according to an embodiment of the present invention. FIG. 1 is an illustration showing an entire structure of an image forming apparatus 1 according to an embodiment of the present invention. FIG. 2 is a perspective view of the image forming apparatus 1 shown in FIG. 1.

The image forming apparatus 1 can be any apparatus such as a copy machine, a copy machine having a printer function or a copy machine having a facsimile function and a printer function, which has an internal paper-eject structure in which printed papers are ejected onto a tray provided inside an apparatus body. The image forming apparatus 1 comprises: an image forming part 2 performing image formation according to an electrophotography method; a paper supply part (feed bank) 3 arranged under the image forming part 2; an internal paper-eject part 4 arranged above the image forming part 2; an operation part and a document reading part 6 arranged above the internal paper-eject part 4; and an automatic document feeder (ADF) 7 located on the document reading part 6.

Although the structure of the document reading part 6 is omitted, the document reading part 6 comprises a light source for illumination, a movable mirror, an image formation lens and an imaging device such as a charge coupled device (CCD). The document reading part 6 optically reads an image of a document supplied onto a contact glass by the ADF 7 or manual feed, converts the image into electric signals, converts the electric signals into binary image data by an image processing circuit, and, thereafter, transmits the image data to the image forming part 2.

The image forming part 2 comprises: a photoconductor 21 as an image carrier; a charger 22 for charging the photoconductor 21; an optical writing device 23 that forms an electrostatic latent image by irradiating a light corresponding to the image data onto the charged photoconductor 21; a developer 24 that develops the latent image formed on the photoconductor by a toner as a developer so as to visualize the latent image; a register roller 25 that feeds a transfer material such as a recording paper supplied from the paper supply part 3 to a transfer in synchronization; a transfer device 26 that transfers the visible image (toner image) onto the transfer material; a cleaning device 27 that removes the toner remaining on the photoconductor 21 after the transfer; a conveyance belt that conveys the transfer material on which the toner images are formed; and a cleaning equipment 27 from which fixing device 29 that fixes the unfixed toner image on the transfer material conveyed by a conveyance belt 28. Here, the charger 22 may be selected from a charger roller, a charger brush and a solid-state charger. Also, the optical writing device 23 can be selected from an optical scanning system that combines a laser light source, an optical deflector and lenses or a system combining a light-emitting diode (LED) and an image forming system (rod lens array, micro lens array, etc.). The developing device 24 can be selected from a device using a single component developing system using a magnetic toner or a non-magnetic toner as a developer and a two-component developing system using a toner and a magnetic carrier. The transfer device can be selected from a transfer roller, a transfer charger and a transfer belt. It should be noted that, when using the transfer belt, a function of the transfer belt 28 can be achieved by the transfer belt. Moreover, the conveyance belt 28 is not necessarily provided, and substituted by a guide plate, a conveyance roller, etc. The cleaning device 27 can be selected from a device of a blade type, a brush type and a roller type. The fixing device 29 can be selected from a thermal roller fixing system using a heat roller and a pressure roller, a belt fixing system using a heat belt and a pressure belt and a system combining a belt and rollers. Moreover, an upward conveyance part 30 is provided in an area from a downstream side of the fixing device 29 of the image forming part 2 to the internal paper-eject part 4 provided above the image forming part. The transfer material after fixation is conveyed upward with a plurality of conveyance rollers 30*a*-30*d* of the upward conveyance part 30, and ejected onto a paper-eject tray through an opening provided in a sidewall 4*b* of the internal paper-eject part 4.

The paper supply part 3 is a paper feed bank in which paper supply cassettes 31*a*-31*c* each of which accommodates transfer materials such as recording papers are arranged in three stages in the example shown in FIG. 1. The transfer materials of different sizes such as A4, B4, B5, etc., are accommodated in the corresponding three stage paper supply cassettes 31*a*-31*c*. The transfer materials are supplied to a conveyance path from one of the paper feed cassettes, which is selected by an operation to the operation part 5 or automatically selected according to the document size, by paper feed rollers 32*a*-32*c* and paper feed rollers 33*a*-33*c*. The conveyance path in the paper supply part is provided with conveyance rollers 34*a*-34*c*. Moreover, the conveyance path in the image forming part 2 is provided with conveyance rollers 35. The transfer materials are conveyed to resister rollers 25 by these conveyances rollers, and are supplied to a transfer part by the register rollers 25 at an appropriate timing. The internal paper eject part 4 is provided between the image forming part 2 and the document reading part 6. Also a paper eject tray 4*a*, which serves as a partition, is provided between the internal paper eject part 4 and the image forming part 2. Although the left and right sides and rear side of the internal paper eject part 4 are surrounded by walls, the front side of the internal paper eject part 4 is open so that the transfer materials ejected onto the paper eject tray 4*a* can be easily taken out.

It should be noted that although the image forming part 2 shown in FIG. 1 is configured to from a monochrome image, the image forming part 2 is not limited to such a structure and may be configured to form a multi-color image or a full-color image. For example, although illustration is omitted, an intermediate transfer member (an intermediate transfer belt or an intermediate transfer drum) may be provided between the photoconductor 21 and the transfer device 26, and a plurality of developers (for example, four developers such as yellow (Y), magenta (M), cyan (C) and black (Bk)) may be arranged with respect to the photoconductor 21. According to the above-mentioned structure, images of each color Y, M, C, and Bk are sequentially formed on the photoconductor 21 and the images are transferred onto an intermediate transfer member in a superimposed manner, and, thereafter, the images is transferred onto the transfer material by the transfer device at once and is fixed so as to form a color image. Moreover, the image forming part 2 may be configured as a color image forming part generally referred to as a tandem type in which a plurality of image forming unit containing a photoconductor and peripheral parts are arranged along a transfer device (transfer belt). Moreover, the paper supply cassettes of the paper supply part 3 is not limited to the three stage structure as shown in FIG. 1, and the number of stages may be changed to an arbitrary number such as two, four, five, etc.

In the image forming apparatus 1 of the structure as mentioned above, although an area occupied by the image forming apparatus 1 is reduce since a space of the paper eject part is provided between the image forming part 2 and the document reading part 6, the height of the image forming apparatus 1 is increased. Especially, the image forming apparatus 1 becomes tall if the multi-stage paper supply part 3 is provided under the image forming part 2. For this reason, in order to maintain the height of the image forming apparatus 1 within allowable height, it is necessary to reduce the space for the image forming part 2. However, if the space of the image forming part is reduced, workability of maintenance operations is deteriorated. Additionally, there is a problem in that it is difficult to perform a process to remove jammed papers when paper jam occurs in the conveyance path.

Figure 4:
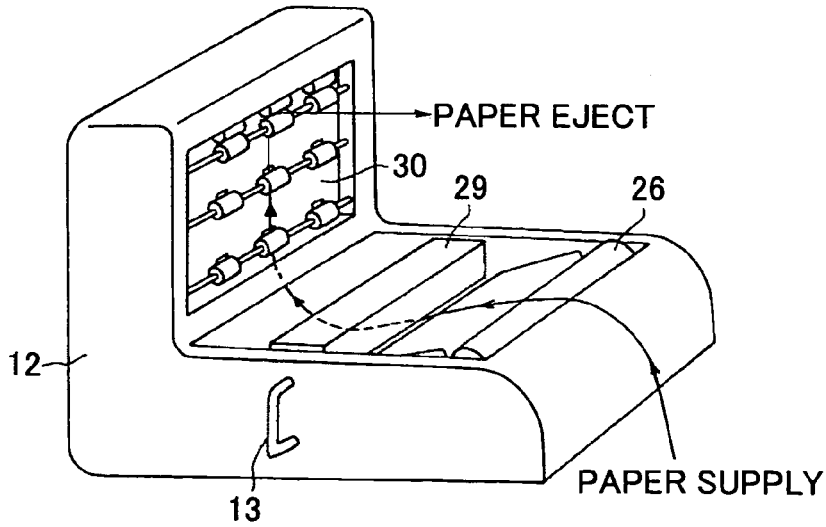
FIG. 4 is a perspective view of a conveyance unit provided in the image forming apparatus shown in FIGS. 1 and 2.

Thus, in the present invention, the transfer device 26 which transfers images on the photoconductor to the transfer material, the fixing device 29 which fixes the image transferred onto the transfer material, and the upward conveyance part 30 which conveys the transfer material after fixation toward the internal paper eject part above the image forming part are incorporated into a single unit 12. Here, FIG. 4 is an illustrative perspective view of the conveyance unit 12. As shown in FIGS. 1 and 4, the transfer apparatus 26, the conveyance belt 28 (or a guide plate, conveyance rollers and conveyance rollers, etc.) and the fixing device 29 are arranged in the conveyance unit 12, and an upper part of the conveyance unit 12 is opened wide. Moreover, in the conveyance unit 12, the upward conveyance part 30 is provided so as to extend upwardly along the side of the internal paper eject part 4 from an end of the image forming part 2 in the conveyance unit 12. Thus, the entire conveyance unit 12 including from the transfer device 26 to the upward conveyance part 30 is configured and arranged to be drawable from the front side of the main body of the image forming apparatus 1, and a handle 13 (or lever, etc.) is provided on the front side of the conveyance unit 12.

As mentioned above, in the present embodiment, parts constituting the path along which a supplied transfer material is subjected to a transfer process, a fixation process and an eject process are incorporated into a single conveyance unit 12, and also the entire unit from the transfer device 26 to the upward conveyance part 30 is configured to be drawable from the front side of the apparatus body of the image forming apparatus. Thus, when a maintenance operation is needed or when paper jam occurs, the maintenance operation or an operation to remove jammed papers can be performed in a state where the conveyance unit 12 is drawn from the front side of the main body of the image forming apparatus 1, which greatly improves workability of the operations. It should be noted that, although not illustrated, the photoconductor 21, the electric charger 22, the development device 24 and the cleaning device 27 may be accommodated in a single unit so as to constitute an image forming unit so that the unit can be drawn from the front side of the main body of the image forming apparatus. In such as case, the workability of operations can be further improved.

Figure 3:
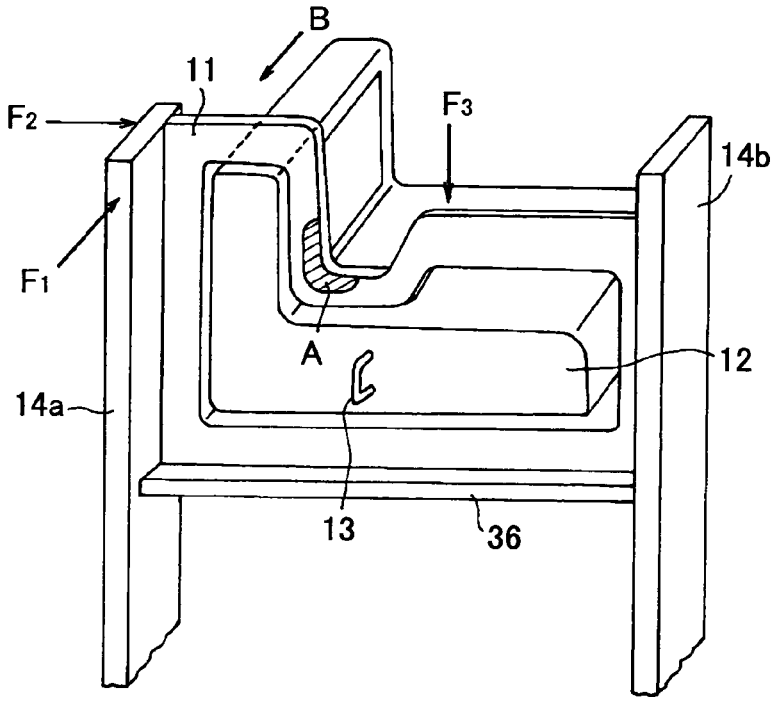
FIG. 3 is a perspective view of a front-side plate frame and a pipe frame provided in an apparatus body of the image forming apparatus shown in FIGS. 1 and 2.

In the meantime, in the image forming apparatus having the internal paper eject part, a part of the apparatus body corresponding to the front side of the internal paper eject part 4 is open so that printed papers ejected on the tray 4*a* of the internal paper-eject part 4 can be taken out easily. For this reason, there is a problem in that a sufficient strength cannot be provided to the front side of the apparatus body. Thus, in the present embodiment, a front side plate frame 11 is provided as a reinforcing member which serves as a part of the front side of the image forming apparatus as a component member of a frame forming the apparatus body. As shown in FIGS. 1 and 3, the front-side plate frame 11 is provided along a periphery of the front-side opening part of the image formant part 2, and has a configuration which protrudes upward along the side of the internal paper eject part 4 and has a shape which permits a removal of a part corresponding to the drawable part of the conveyance unit 12. Thus, the conveyance unit 12 can be easily drawn forwardly (a direction indicated by an arrow B in FIG. 3), and a sufficient strength can be maintained in a periphery of the image forming part 2 and the internal paper eject part 4.

Additionally, as shown in FIGS. 1 and 3, the front-side plate frame 11 is configured to protrude upward toward the internal paper eject part so as to extend along the side of the internal paper eject part 4, and the opening part is provided in the front-side plate frame 11 so that the conveyance unit 12 can be drawn therethrough. Thus, a sufficient strength of the part from the image forming part 2 to the side of the internal paper eject part 4 can be maintained, while the conveyance unit 12 including parts performing from the transfer operation to the eject operation can be easily drawn. However, since the front-side plate frame 11 has a structure in which a large opening part is provided therein, strength of the front-side plate frame 11 may be reduced.

Thus, in the present embodiment, the front-side frame 11 is configured to be sandwiched between component members of the frame constituting the apparatus body. More specifically, the front-side plate frame 11 is sandwiched between pipe frames 14*a* and 14*b* which are uprightly provided on a base 37 to serve as support columns for the frame constituting the apparatus body, and the front-side plate 11 is fixed to the pipe frames 14*a* and 14*b* by screws or welding. Thereby, the front-side plate frame 11 can be reinforced. It should be noted that the bottom side of the front-side plate frame 11 is fixed to a transverse frame 36, which serves as a part of the frame of the apparatus body, by screws or welding.

By sandwiching the front-side plate frame 11 between the pipe frames 14*a* and 14*b*, the front-side plate frame 11 is permitted to have the protruding part and the opening part, which can compensate for the reduction in the strength of the front-side plate frame. That is, since the pipe frames 14*a* and 14*b* have a pipe frame structure having a high strength, the sandwiching of the front-side plate frame 11 between the pipe frames 14*a* and 14*b* can improve the strength of the front-side plate frame 11 against a force in a cross direction (indicated by an arrow F1 in FIG. 3) and a force in a lateral direction (indicated by an arrow $F_2$ in FIG. 3).

According to a strength analysis of the front-side late frame having the structure shown in FIGS. 1 and 3 using a computer simulation, it was confirmed that a large stress concentration occurs in an area near the base of the protruding part (a hatched area A in FIG. 3) of the front-side plate frame 11 when a force is applied to the front-side plate frame 11 in a lateral direction (the direction indicated by the arrow F2 in FIG. 3) or from directly above (a direction indicated by an arrow F3 in FIG. 3). Since the area near the base of the protruding part of the front-side plate frame 11 is a part for receiving a load applied to the paper eject tray 4*a* of the internal paper eject part 4, it causes a damage of the paper eject tray if a strength of this part is small.

Figure 5:
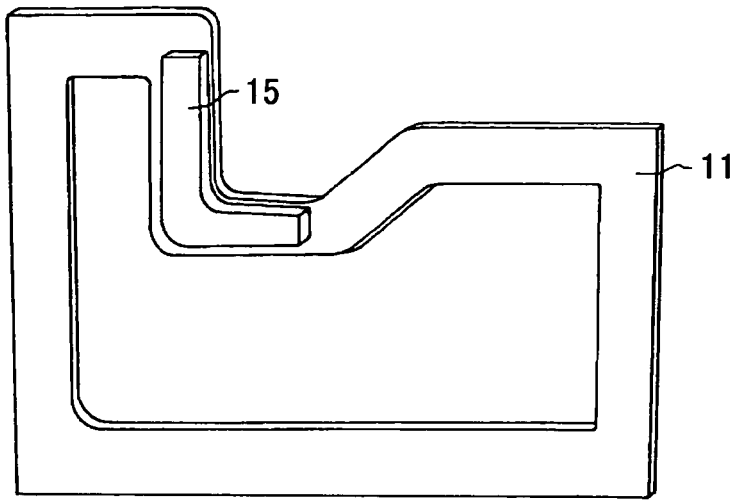
FIG. 5 is a perspective view of a front-side plate frame and a reinforcing member provided in the image forming apparatus shown in FIGS. 1 and 2.

Accordingly, in the present embodiment, a reinforcing member is provided in the area near the base of the protruding part (the hatched area A in FIG. 3) of the front-side plate frame 11 where a stress is concentrated. Specifically, as shown in FIG. 5, a reinforcing plate (bracket) 15 of an L-shape is attached to the base of the protruding part of the front-side plate frame 11 and fixed by screws or welding. Thus, in the present embodiment, the base of the protruding part, into which a stress tends to be concentrated when a load is applied to the front-side plate frame 11, is especially reinforced, an efficient reinforcing effect can be obtained.

In the image forming apparatus having the above-mentioned structure, there are provided a part to which a high-voltage is applied such as the electric charger 22 or the transfer device 26. Accordingly, it is very dangerous if a person contacts these parts when performing a maintenance operation or an operation for removing jammed papers. Additionally, there is a risk of injury if an operator's hand is caught by rollers or a belt when the apparatus operates during work. Thus, an interlock mechanism is provided in the image forming apparatus according to the present embodiment so as to detect an opening and closing of a door provided on the front or the side of the apparatus to control operations of the apparatus. That is, the interlock mechanism automatically stops the operations of the apparatus and turns off a high-voltage supply when the door is open and continues to turn off until the door is closed.

The interlock mechanism comprises an interlock switch and a link mechanism that links with a motion of the door so as to turn the interlock switch on or off, and the interlock switch must operate accurately when the door is closed. However, if a door locking magnet and the link mechanism of the interlock mechanism are attached in separate location via separate members, there may be a large difference tends to occur in a positional relationship in operations of the interlock mechanism.

Figure 6:
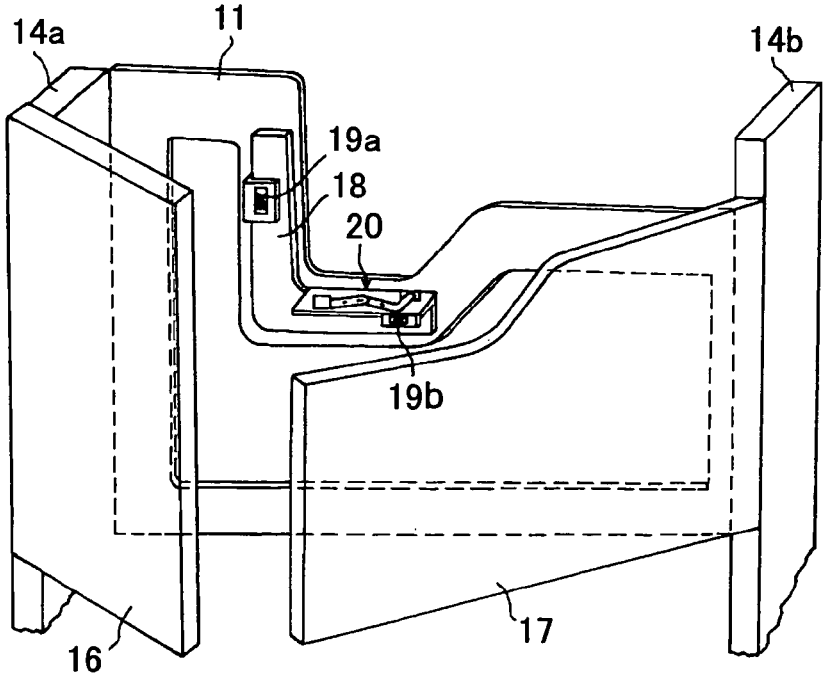
FIG. 6 is a perspective view of a front-side cover and a front-side plate frame shown in FIGS. 1 and 2.

Thus, in the present embodiment, as shown in FIG. 6, an outer front-side cover that corresponds to a door on the front side of the image forming apparatus formed as a double door structure having a left front cover 16 and a right front cover 17, and a boundary between the covers 16 and 17 is set to extend near the root of the protruding part of the front-side plate frame 11. Additionally, magnets 19*a* and 19*b* are integrally attached to the reinforcing member 18 of the front-side plate frame 11 so as to lock the covers 16 and 17 when the covers 16 and 17 are closed. That is, the bracket 18, which is integral with the magnets 19*a* and 19*b* for locking the outer front cover and serves as a reinforcing member, is attached to the root of the protruding part of the front-side plate frame 11 where a stress tends to be concentrated. Further, in the present embodiment, the interlock mechanism 20 is provided to the bracket 18 of the front-side plate frame 11 so as to control an operation of the image forming apparatus by detecting opening and closing of the outer front covers 16 and 17.

Figure 7A:
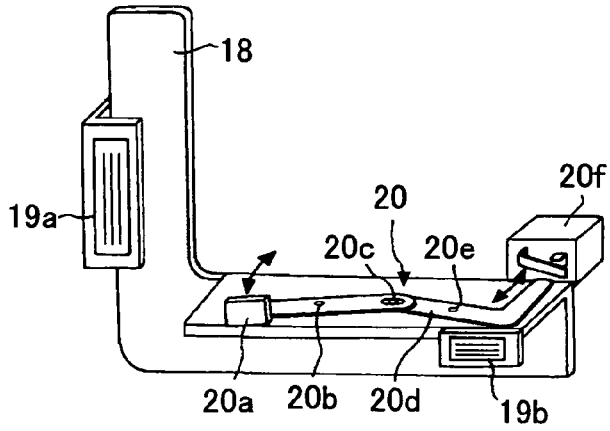
FIG. 7A is a perspective view of a reinforcing member and an interlocking mechanism attached to the reinforcing member.
Figure 7B:
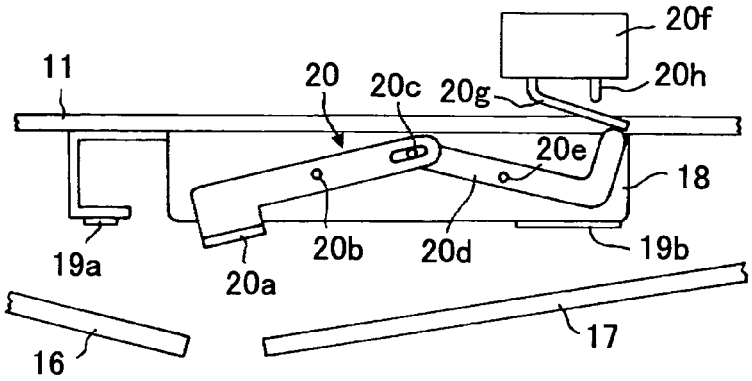
FIG. 7B is a plan view of the interlocking mechanism when a front-side cover is open.
Figure 7C:
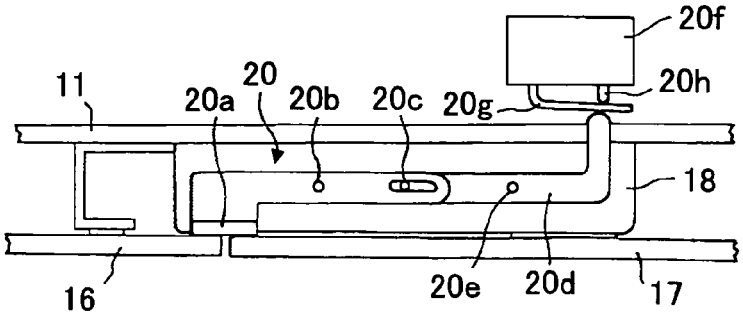
FIG. 7C is a plan view of the interlocking mechanism when the front-side cover is closed.

FIG. 7A shows a perspective view of the bracket 18 and the interlock mechanism 20. FIG. 7B is a plan view of the interlock mechanism for explaining the operation thereof when the outer front cover is open. FIG. 7C is a plan view of the interlock mechanism for explaining the operation thereof when the outer front cover is closed. Attached to the bracket 18, which also serves as a reinforcing member, are the magnets 19*a* and 19*b* for locking the outer front cover and the link mechanism which constitutes the interlock mechanism 20. The link mechanism comprises: two support axes 20*b* and 20*e* fixed to a table provided to the bracket 18; two swing members 20*a* and 20*d* swingably supported by the respective support axes 20*b* and 20*e*; and a connection part 20*c* formed by ends of the swing members 20*a* and 20*d*. In FIGS. 7A, 7B and 7C, an end of the swing member 20*a* on the left side is located at the boundary between the front covers 16 and 17, and an end of the swing member 20*d* on the right side is engaged with a spring 20*g* of an interlock switch 20*f* fixed to the frame side of the apparatus body.

In a state shown in FIG. 7B where the front covers 16 and 17 are open, the end of the swing member 20*d* on the right side is separated from the switch 20*h* according to an action of the spring 20*g* of the interlock switch 20*f*, and the interlock switch is in an OFF state. When the left and right front covers 16 and 17 are closed as shown in FIG. 7C (that is when metal parts (not shown in the figure) attached to the left and right front covers 16 and 17 are brought into contact with the magnets 19*a* and 19*b*), the end of the swing member 20*a* on the left side is pressed into the bracket 18. Linking with this motion, the end of the swing member 20*d* on the right side pushes the switch 20*h* against the spring 20*g* of the interlock switch 20*f*, and the interlock switch is turned on. Thereby, an operation of the apparatus can be started immediately after the front cover is closed. On the other hand, when the front covers 16 and 17 are opened as shown in FIG. 7B from the state shown in FIG. 7C, the push of the link mechanism is cancelled. Accordingly, the interlock switch 20*f* is turned off, the operation of the apparatus is stopped, and the high-voltage supply is turned off.

As mentioned above, in the present embodiment, an accuracy of operations of the interlock switch 29*f* is improved by providing the magnets 19*a* and 19*b* for locking the front covers 16 and 17 and the link mechanism of the interlock mechanism 20 to the same member, that is, the bracket 18. Moreover, by locating the bracket 18 having the above-mentioned mechanism at a root of the protruding part where a stress tends to be concentrated, the front-side plate frame 11 can be strengthened with less component parts.

The present invention is not limited to the specifically disclosed embodiments, and variations and modifications may be made without departing from the scope of the present invention.

The present application is based on Japanese priority application No. 2003-114219 filed Apr. 18, 2003, the entire contents of which are hereby incorporated by reference.

What is claimed is:

1. A conveyance unit configured and arranged to be used in an image forming apparatus having an image forming part configured to form a visible image on a transfer material; and an internal eject part provided above the image forming part within said image forming apparatus, wherein said conveyance unit is provided on a conveyance path from said image forming part to said internal eject part, said conveyance unit comprising:

a transfer device that transfers the visible image, which is formed on an image carrier, onto the transfer material;

a fixing device that fixes the visible image transferred to the transfer material; and an upward conveyance part that conveys and ejects the transfer material having a fixed visible image to the internal eject part, wherein said transfer device, said fixation device and said upward conveyance part are incorporated into a single unit.

2. The conveyance unit as claimed in claim 1, wherein said upward conveyance part extends, when situated in said image forming apparatus, upwardly from an end of said conveyance unit and along a side of said internal eject part.

3. The conveyance unit as claimed in claim 1, wherein the entire conveyance unit is configured and arranged to be removable from an interior of an apparatus body of said image forming apparatus through a front side of said apparatus body.

4. An image forming apparatus comprising:

an image forming part that forms a visible image on a transfer material;

an internal eject part provided above the image forming part within said image forming apparatus; and a conveyance unit provided on a conveyance path from said image forming part to said internal eject part, wherein said conveyance unit includes:

a transfer device that transfers the visible image, which is formed on an image carrier, onto the transfer material;

a fixing device that fixes the visible image transferred to the transfer material; and an upward conveyance part that conveys and ejects the transfer material having a fixed visible image to the internal eject part, wherein said transfer device, said fixation device and said upward conveyance part are incorporated into a single unit.

5. The image forming apparatus as claimed in claim 4, wherein said upward conveyance part extends, when situated in said image forming apparatus, upwardly from an end of said conveyance unit and along a side of said internal eject part.

6. The image forming apparatus as claimed in claim 4, wherein the entire conveyance unit is configured and arranged to be removable from an interior of an apparatus body of said image forming apparatus through a front side of said apparatus body.

7. A structure of a front-side plate frame serving as a reinforcing member to reinforce a front side of an image forming apparatus, the image forming apparatus comprising:

an image forming part that forms a visible image on a transfer material;

an internal eject part provided above the image forming part within said image forming apparatus; and a conveyance unit provided on a conveyance path from said image forming part to said internal eject part, wherein said conveyance unit includes:

a transfer device that transfers the visible image, which is formed on an image carrier, onto the transfer material;

a fixing device that fixes the visible image transferred to the transfer material; and an upward conveyance part that conveys and ejects the transfer material having a fixed visible image to the internal eject part, wherein said transfer device, said fixation device and said upward conveyance part are incorporated into a single unit, and said front-side plate frame is provided along a periphery of a front-side opening of said image forming part and has a protruding part extending upward along a side of said internal eject part and has an opening corresponding to an outer configuration of said conveyance unit, and wherein a reinforcing member is attached to said front-side plate frame at an area corresponding to a base of said protruding part, where a stress is concentrated when a load is applied to said front-side plate frame.

8. The structure of the front-side plate frame as claimed in claim 7, wherein said front-side plate frame is interposed between component parts of a frame member constituting an apparatus body of said image forming apparatus.

9. The structure of the front-side plate frame as claimed in claim 8, wherein said component parts of the frame member are pipe frames serving as columns of said frame member.

10. The structure of the front-side plate frame as claimed in claim 7, wherein said reinforcing member is an L-shape bracket.

11. The structure of the front-side plate frame as claimed in claim 7, wherein an outer front cover covering the front side of said image forming part is configured to be a double door structure so that a center line of the double door passes through the base of said protruding part, and said reinforcing member is a bracket having a magnet for locking the outer front cover.

12. The structure of the front-side plate frame as claimed in claim 11, further comprising an interlock mechanism provided to said bracket so as to detect opening and closing of said outer front cover and control an operation of said image forming apparatus.

13. An image forming apparatus comprising:

an image forming part that forms a visible image on a transfer material;

an internal eject part provided above the image forming part within said image forming apparatus;

a conveyance unit provided on a conveyance path from said image forming part to said internal eject part, said conveyance unit including: a transfer device that transfers the visible image, which is formed on an image carrier, onto the transfer material; a fixing device that fixes the visible image transferred to the transfer material; and an upward conveyance part that conveys and ejects the transfer material having a fixed visible image to the internal eject part, wherein said transfer device, said fixation device and said upward conveyance part are incorporated into a single unit; and a front-side plate frame serving as a reinforcing member to reinforce a front side of said image forming apparatus, said front-side plate frame provided along a periphery of a front-side opening of said image forming part and having a protruding part extending upward along a side of said internal eject part and having an opening corresponding to an outer configuration of said conveyance unit, and wherein a reinforcing member is attached to said front-side plate frame at an area corresponding to a base of said protruding part, where a stress is concentrated when a load is applied to said front-side plate frame.

14. The image forming apparatus as claimed in claim 13, wherein said front-side plate frame is interposed between component parts of a frame member constituting an apparatus body of said image forming apparatus.

15. The image forming apparatus as claimed in claim 14, wherein said component parts of the frame member are pipe frames serving as columns of said frame member.

16. The image forming apparatus as claimed in claim 13, wherein said reinforcing member is an L-shape bracket.

17. The image forming apparatus as claimed in claim 13, wherein an outer front cover covering the front side of said image forming part is configured to be a double door structure so that a center line of the double door passes through the base of said protruding part, and said reinforcing member is a bracket having a magnet for locking the outer front cover.

18. The image forming apparatus as claimed in claim 17, further comprising an interlock mechanism provided to said bracket so as to detect opening and closing of said outer front cover and control an operation of said image forming apparatus.

* * * * *